US010655325B2

(12) United States Patent
Tourneur et al.

(10) Patent No.: US 10,655,325 B2
(45) Date of Patent: May 19, 2020

(54) METHOD FOR MANUFACTURING A BALLAST MASS

(71) Applicant: SOLETANCHE FREYSSINET, Rueil Malmaison (FR)

(72) Inventors: Christian Tourneur, Le Mesnil Saint-Denis (FR); Antoine Domange, Paris (FR); Guy Sevoz, Montigny le Bretonneux (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 16/320,873

(22) PCT Filed: Jul. 26, 2017

(86) PCT No.: PCT/FR2017/052091
§ 371 (c)(1),
(2) Date: Jan. 25, 2019

(87) PCT Pub. No.: WO2018/020159
PCT Pub. Date: Feb. 1, 2018

(65) Prior Publication Data

US 2019/0161961 A1 May 30, 2019

(30) Foreign Application Priority Data

Jul. 29, 2016 (FR) ..... 16 57427

(51) Int. Cl.
*E04B 1/98* (2006.01)
*B65H 54/71* (2006.01)
*B65H 54/76* (2006.01)

(52) U.S. Cl.
CPC ..... *E04B 1/985* (2013.01); *B65H 54/71* (2013.01); *B65H 54/76* (2013.01)

(58) Field of Classification Search
CPC ..... E04B 1/985; B65H 54/76; B65H 54/71; E04H 9/14
See application file for complete search history.

(56) References Cited

U.S. PATENT DOCUMENTS 5,038,536 A * 8/1991 De Mendoza Sans ... B66B 9/06 52/146
9,315,357 B2 * 4/2016 Souwand ..... B65H 51/14
(Continued)

FOREIGN PATENT DOCUMENTS

WO 2013/151580 A1 10/2013
WO 2014/198277 A1 12/2014

OTHER PUBLICATIONS

International search report for PCT/FR2017/052091 (6 pages). (Year: 2017).*

(Continued)

*Primary Examiner* — Rodney Mintz
(74) *Attorney, Agent, or Firm* — Dentons US LLP

(57) ABSTRACT

Method for producing a ballast weight for damping vibrations of a structure, the ballast weight being formed from ballast components comprising a part of a ballast cable, the method comprising: connecting the ballast cable to a conveying device, by the conveying device, moving successive portions of the ballast cable from a low point to a high point, and forming the ballast weight from a part of the successive portions of the ballast cable which have been conveyed to the high point.

12 Claims, 3 Drawing Sheets

(56) References Cited

U.S. PATENT DOCUMENTS

| | | | | |
|---|---|---|---|---|
| 9,701,520 | B2 * | 7/2017 | Pruskauer | B66D 1/605 |
| 2014/0119866 | A1 | 5/2014 | Pruskauer | |
| 2015/0251872 | A1 * | 9/2015 | Souwand | B65H 51/14<br>156/185 |

OTHER PUBLICATIONS

English Translation of the Written Opinion for PCT/FR2017/052091 (7 pages). (Year: 2018).*

* cited by examiner

METHOD FOR MANUFACTURING A BALLAST MASS

This application is the National Stage Entry of International Application No. PCT/FR2017/052091, filed on Jul. 26, 2017, which claims priority and the benefit of French patent application No. FR 16 57427, filed Jul. 29, 2016, both of which are hereby incorporated by reference in their entirety for all purposes as if fully set forth herein.

FIELD OF THE DISCLOSURE

The disclosure concerns the production of ballast weights at height.

BACKGROUND OF THE DISCLOSURE

Nowadays, the height of buildings holding construction records is close to or in excess of 1000 m (39370 in). The construction of such towers does not necessarily conform to economic prerogatives, but rather to a preoccupation to take up a technological challenge that certain builders impose on themselves in order to show their boldness and their skill. Such towers, in fact, give rise to technological problems that are very difficult to solve using current techniques and materials.

The first of said difficulties is related to wind resistance. The weight and the ground pressure can be resolved easily enough using high-performance materials and sections that are more or less large.

However, the fact that a tower can sway or become unstable in the wind is much more complicated to overcome.

In order to define an optimized form for towers, use is generally made of trials undertaken in wind tunnels, however in spite of optimizing the geometric configuration of the towers, their swaying remains a serious handicap.

So as to remedy these problems, damping systems which are intended to prevent or limit the amplitude of the swaying are often used.

Such systems absorb a large part of the energy introduced into the primary structure of the buildings and influence the dynamic behaviour of the structure.

A large number of types of damping systems exist in this regard. They are often made up of oscillating ballast weights which are placed close to the top of the buildings and which are braked by being connected to the structure by means of dampers.

The ballast weights are, for example, mounted on sliding or rolling systems or are simply suspended by means of one or several hangers.

The common point of said devices is the need to arrange large ballast weights.

For example, for a tower which is 1000 m (39370 in) in height, the ballast necessary within said type of damping device can have a weight in the vicinity of 1000 tonnes (1101.31 short tons).

Bringing such weights to a great height gives rise to a problem of conveying materials. The ballast components conventionally used are in the form, for example, of metal pigs that are conveyed by means of site cranes. Said operation blocks the cranes for long periods and paralyzes the progress of the rest of the construction, which has tangible repercussions on the construction costs and the corresponding delays.

OBJECTS AND SUMMARY OF THE DISCLOSURE

The object of the present disclosure is to propose a technical solution which allows the ballast to be conveyed to any height whatsoever independently of any lifting means on a site with regard to the production of ballast weights at height.

To this end, the disclosure concerns a method for producing a ballast weight for damping vibrations of a structure, the ballast weight being formed from ballast components comprising at least part of a ballast cable, the method comprising:

- connecting the ballast cable to a conveying device,
- by means of the conveying device, moving successive portions of the ballast cable from a low point to a high point, and
- forming the ballast weight from at least part of the successive portions of the ballast cable which have been conveyed to the high point.

According to one aspect of the disclosure, the method furthermore comprises splitting the ballast cable at at least one portion which has been conveyed to the high point so as to form, from the ballast cable, ballast segments which are separate from one another.

According to one aspect of the disclosure, the ballast weight is formed from ballast segments obtained from portions of the ballast cable.

According to one aspect of the disclosure, the ballast segments are arranged in a housing from which the ballast weight is formed.

According to one aspect of the disclosure, for at least part of the successive portions, each ballast segment newly formed from said successive portions is arranged in a container.

According to one aspect of the disclosure, the container is movable along at least one axis and inside delimits a receiving cavity which has a receiving opening and, for at least part of the successive portions:

- each portion conveyed to the high point is engaged through the receiving opening of the container by means of the conveying device before being split from the rest of the cable in order to form a ballast segment which is arranged in the container, and
- the container is regularly moved until a predetermined number of ballast segments is received in the container.

According to one aspect of the disclosure, the container has a window, the method further comprising tightening ballast segments received in the container together by means of a strapping which is engaged through said window for forming a bundle of segments.

According to one aspect of the disclosure, for at least part of the successive portions:

- an initial portion of said successive portions is connected to a winding device once it has been conveyed to the high point,
- the winding device is actuated while new portions reach the high point so as to form, via the winding device, at least one reel from successive portions conveyed to the high point.

According to one aspect of the disclosure, the winding device comprises guide rollers, which are configured in order to guide the portions of the ballast cable and to control the tension of the ballast cable, and a winding machine on which the portions of ballast cable are wound.

According to one aspect of the disclosure, the ballast cable comprises initially a first cable part situated in the vicinity of the low point, the method further comprising:

- obtaining a second cable part in the vicinity of the low point, and
- splicing an end of the first cable part to an end of the second cable part.

According to one aspect of the disclosure, the cable is moved by the conveying device in a duct which extends over at least part of the path between the low point and the high point.

According to one aspect of the disclosure, forming the ballast weight comprises filling at least part of a volume within the ballast weight and within which the successive portions are arranged, with a ballast material.

The disclosure furthermore concerns an assembly for producing a ballast weight for damping vibrations of a structure, the ballast weight being formed from ballast components comprising at least part of a ballast cable, the assembly being fixed in relation to the structure and comprising a conveying device which is adapted to be connected to the ballast cable and to move the successive portions of the ballast cable from a low point of the structure to a high point of the structure.

According to one aspect of the disclosure, the conveying device comprises a pulling apparatus which is arranged in the vicinity of the high point and is configured to pull the ballast cable for conveying successive portions of the ballast cable to the high point.

According to one aspect of the disclosure, the assembly furthermore comprises a splitting device which is adapted to split the ballast cable at at least one portion which has been conveyed to the high point so as to form, from the ballast cable, ballast segments which are separate from one another.

BRIEF DESCRIPTION OF THE DRAWINGS

The disclosure will be better understood on reading the detailed description below, given solely by way of example and made with reference to the accompanying Figures, in which.

MORE DETAILED DESCRIPTION

Figure 1:
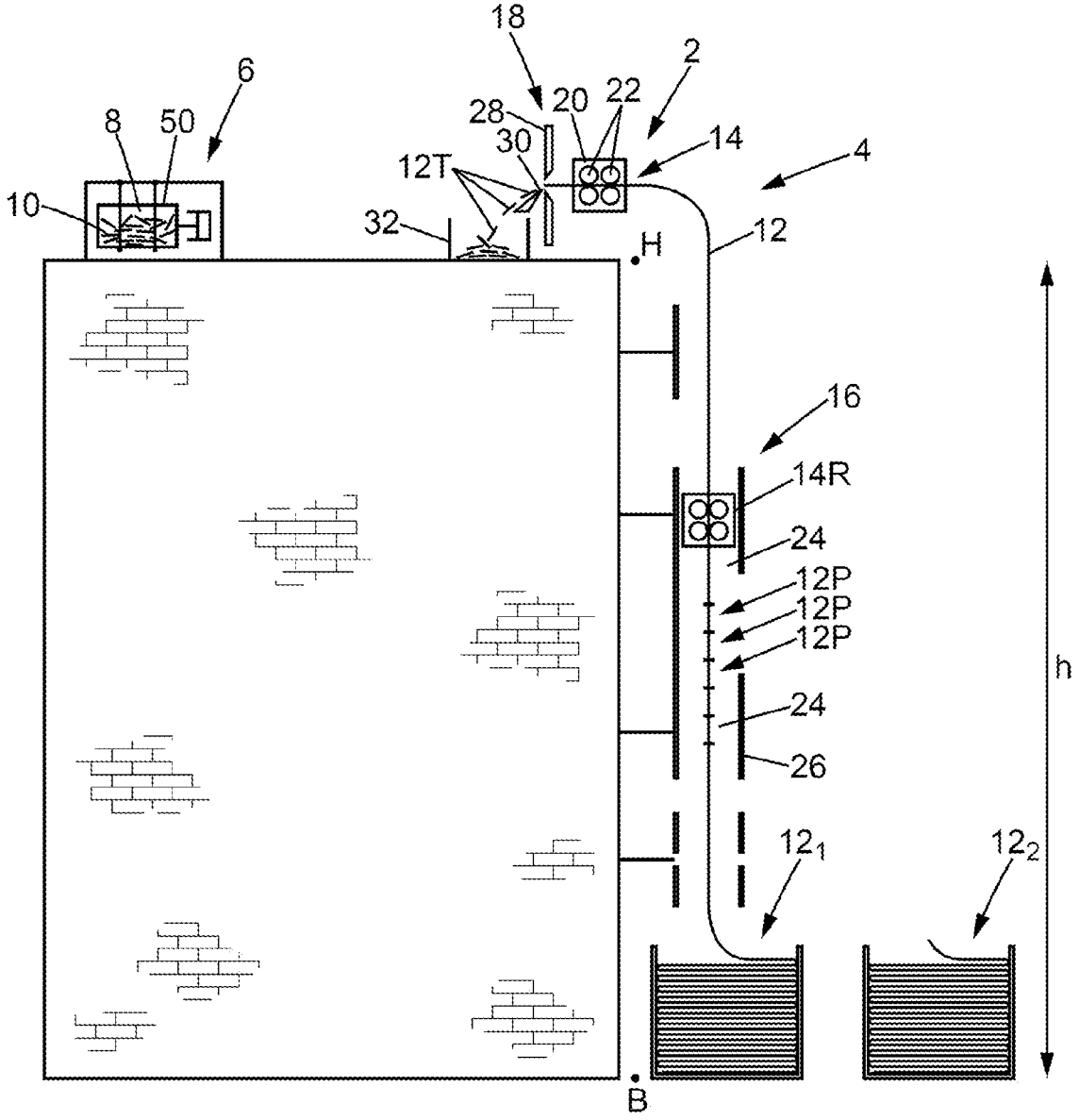
FIG. 1 illustrates a structure to which an assembly according to the disclosure has been connected.

FIG. 1 illustrates a structure 2 to which an assembly 4 according to the disclosure is connected.

The structure 2 is a work of engineering, in particular a work of civil engineering, such as, for example, a high-rise tower. The height of the structure 2 is, for example, in excess of 100 m (3937 in), 200 m (7874.01 in) or 300 m (11811.02 in), or even 500 m (19685.04 in). For example, the structure 2 has a height of approximately 1000 m (39370.08 in).

The structure 2 is intended to be provided with at least one damper 6 which is shown schematically in FIG. 1. The damper 6 is intended to comprise a ballast weight 8 which is realized from ballast components 10.

The damper 6 is, for example, a pendulum damper. The damper is, for example, an agreed weight pendulum damper, that is to say the ballast weight 8 of which has a controlled swaying frequency in order to correspond with the swaying frequency of the structure 2.

The ballast weight 8 is, for example, suspended within the damper by one or several hangers and is connected to the frame of the damper by means of an energy dissipation device, such as, for example, a damper piston.

As an alternative to this, the ballast weight 8 is arranged on a rolling carriage which is connected to the frame of the damper by a spring for controlling the ratio between the swaying frequency of the weight 8 and the frequency of the structure 2, and is also connected to the frame by an energy dissipation device.

It is noted that the ballast weight can have any form whatsoever, defined notably in terms of the fact of whether it is intended to be visible or not.

In an advantageous manner, the ballast weight has a weight in excess of 100 tonnes (110.23 short tons). For example, said weight is in excess of 300 tonnes (330.693 short tons), and in an advantageous manner is in excess of 500 tonnes (551.156 short tons).

Within the framework of the disclosure, the ballast components 10 used to form the ballast weight 8 comprise at least part of a ballast cable 12.

The ballast cable 12 is, for example, realized from metal, such as, for example, soft iron or steel.

Its section is in whatever form. For example, it is rectangular or circular.

Its section has a diameter (or a characteristic dimension) within the range of 3 and 10 mm (0.118 and 0.394 in) inclusive. In an advantageous manner, said diameter is, for example, 6 mm (0.236 in).

It linear density is, for example, between 0.05 and 0.75 kg/m (0.033 lb/ft$^3$ and 0.50 lb/ft) inclusive.

Its mechanical strength is sufficient to enable the cable, without deteriorating, to pick up a weight corresponding to a cable length in excess of 30% of the distance between a high point H and a low point B described below, and advantageously in excess of 75% of said distance, and even advantageously equal to or in excess of 100% of said distance.

Furthermore, it is sufficiently deformable in order to adjust to the layout imposed by the assembly 4 without any stresses that are likely to deform it plastically.

In a specific example, the cable is, for example, a steel cable with a density of substantially 7850 kg/m$^3$ (490 lb/ft), with an elastic limit of 500 MPa (72.5E3 lbf/in$^2$), an elastic modulus of 200 GPa (290E5 lbf/in$^2$) and a diameter of approximately 6 mm (0.236 in).

The ballast cable 12 comprises a succession of consecutive ballast cable portions 12P which extend between the two ends of the ballast cable 12. In other words, the ballast cable 12 can be seen as a plurality of consecutive cable portions which form the length of the cable (the portions 12P are only shown on part of the cable for the sake of clarity). As described in more detail below, the cable is advantageously intended to be split at said portions so as to form ballast segments 12T which are separate from one another and are used for producing the ballast weight. As made more apparent below, different lengths of segments are feasible.

As an option, the ballast cable 12 comprises, at least in an intermittent manner, two cable parts $\mathbf{12}_1$, $\mathbf{12}_2$ which are spliced together. Each cable part itself comprises consecutive portions 12P which form the length of the corresponding cable part.

The assembly 4 is configured for conveying successive portions 12P of the ballast cable from a low point B to a high point H for forming the ballast weight 8 from portions 12P which are conveyed one after another to the high point H.

Point B is situated, for example, at the foot of the structure 2. Point H is situated, for example, in the vicinity of the top of the structure. The height difference h between said points B and H is, for example, in excess of several tens of meters.

For example, said height is in excess of 100 m (3937 in), 200 m (7874.01 in) or 500 m (19685.04 in).

The assembly 4 comprises a conveying device 14, an ascent route 16 and a splitting device 18.

The conveying device 14 is suitable to move the successive portions of the cable 12 from the point B to the high point H.

It is suitable, for example, to give the ballast cable 12 a running speed in the order of a meter per second. For example, said speed is in excess of or equal to 1 m/s, and in an advantageous manner is in excess of or equal to 2 m/s.

The conveying device 14 comprises advantageously a pulling apparatus 20 which is configured to pull on the cable for the conveying of portions 12P. It is advantageously situated at the high point H, and thus enables portions 12P to be conveyed by traction on the cable.

The pulling apparatus 20 has a plurality of drive rollers 22 intended to be connected to the cable 12 and to exert on the cable a force for the ascent of the cable portions from the low point B towards the high point H.

The pulling apparatus 20 is, for example, in the form of a pulling machine.

In an advantageous manner, the conveying device 14 furthermore comprises one or several relay stations 14R which are situated along the ascent route 16 and are configured also for moving the cable in the direction of the high point H.

Said relay stations have, for example, a configuration which is analogous to that of the pulling apparatus 20, and thus have a plurality of drive rollers which are provided to be connected to the cable.

The presence of said relay stations 14R allows the mechanical power required by the pulling apparatus 20 to be reduced and the traction in the cable to be limited.

In an advantageous manner, the relay stations are synchronized with the pulling apparatus such that they do not exert any force on the cable if the pulling apparatus does not exert any, and vice versa. Furthermore, they are synchronized such that the running speeds of the cable within the different elements of the conveying device are substantially identical.

It is noted that the conveying device 14 can comprise deviation elements (not shown) which are arranged along the path of the cable 12 in order to guide the movement of the cable at certain places and thus to limit the deformation that it faces. For example, such elements are, for example, arranged at the elbow formed by the cable in the surrounding area of the point H in order to limit the curvature of the cable.

The ascent route 16 defines the path taken by the cable during the movement of its portions over at least part of the travel between the low point B and the high point H.

In an advantageous manner, the ascent route 16 comprises a duct 24 for receiving and guiding the cable when it is being moved by the conveying device. The duct 24 is provided, in particular, to contain the lateral movements of the cable 2.

The duct extends over at least part of the travel between the low and high points. The duct 24 has a diameter which is in excess of that of the cable 12.

In an advantageous manner, the duct 24 is delimited inside by a pipe 26 over at least part of its length. The pipe 26 is fixed in relation to the structure 2. It is, for example, fixed to the structure 2.

The pipe 26 extends over at least part of the travel between the low point B and the high point H.

In an advantageous manner, the pipe 26 is substantially straight, and this is so over at least part of its length. In an advantageous manner, it extends furthermore substantially vertically over at least part of its height.

It is noted that the pipe is continuous along its height. As an alternative to this, as illustrated in FIG. 1, over at least part of its height, it is discontinuous.

Furthermore, as an option the pipe 26 has windows in its wall, for example to authorize access to the duct 24 from the outside.

It is noted that, as an option, over at least part of its length, the pipe is formed by guide rings. In other words, the ascent route, on the corresponding portion, is defined by rings spaced apart from one another along the path of the cable, and not by a continuous wall.

In the example in FIG. 1, the pipe extends substantially from the vicinity of the low point B substantially to the high point H. Furthermore, it is discontinuous and has openings in its wall (under the relay station 14R).

The splitting device 18 is configured to split the ballast cable 12 at portions 12P conveyed to the high point H for forming ballast segments 12T.

In an advantageous manner, the splitting device 18 is configured to do this by means of cutting the ballast cable 12.

The splitting device 18 comprises, for example, shearing equipment 28, such as guillotine shears, or rotary shears.

The splitting device 18 is advantageously arranged at point H and downstream of the pulling apparatus 20 (in the direction of the movement of successive portions), the successive portions 12P being engaged in the splitting device 18 after passing through the pulling apparatus 20.

The splitting device 18 is controllable. In particular, it is controllable such that the passage of the portions 12P into the splitting device 18 does not necessarily imply that the portions 12P will be cut.

In practice, as described below, it is controllable for obtaining segments 12T of a chosen length. The control of the splitting device 18 is realized, for example, as a function of the operating parameters of the conveying device, and notably of the running speed that the latter gives to the cable.

Several embodiments of the assembly 4 with respect to the functionalities of the same relating to the splitting and to the handling of the segments 12T are possible.

In the first embodiment illustrated in FIG. 1, the splitting device 18 comprises, along with the elements described above, an outfall 30 which is positioned such that the segments 12T recently separated from the rest of the cable and leaving the splitting device 18 are conveyed towards a low part of the outfall which is intended to be coupled with a container 32 of the assembly 4. Said container is, for example, realized from sheet metal.

In other words, in said embodiment the splitting device 18 is configured such that the segments 12T are automatically discharged into a container 32 which is coupled with the splitting device 18.

It is noted that the presence of the outfall 30 is an option, it being possible to arrange the container under the outlet of the splitting device through which the segments leave the splitting device 18.

Figure 2A:
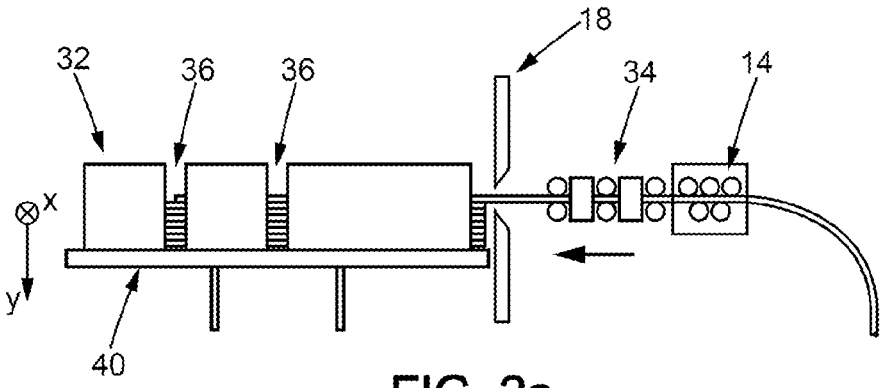
FIGS. 2*a* and 2*b* illustrate an assembly according to a first variant of the disclosure.
Figure 2B:
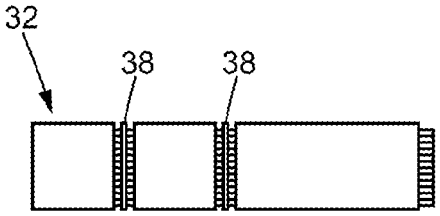

In a second embodiment illustrated in FIGS. 2*a* and 2*b*, the assembly 4 comprises, along with the elements described above, a straightening device 34 which is configured in order to straighten the portions 12P conveyed to it that are likely to be deformed during their ascent along the ascent route. In practice, the straightening device 34 is configured to output straight portions 12P.

The straightening device 34 is advantageously arranged downstream of the pulling apparatus 20 and upstream of the splitting device 18. This allows segments 12T that are themselves straight to be obtained.

As previously, a container 32 is arranged at the output of the splitting device for receiving segments 12T. In said embodiment, the container 32 delimits an interior cavity which is opened by a receiving opening which is suitable for the insertion of portions 12P into the interior cavity. The container 32 has, in addition to this, at least one window 36 for receiving a strapping 38 (FIG. 2*b*) which is suitable for tightening the segments intended to be received by the container 32 together in order to form a bundle of segments.

The assembly 4 comprises, in addition to this, a movement-inducing device 40 suitable for receiving the container 32 and for making the container 32 move. It is suitable, in particular, for receiving the container 32 such that the opening of said container is turned towards the splitting device.

In an advantageous manner, the device 36 is suitable for moving the container 32 that it receives along at least one axis. More specifically, it is suitable in an advantageous manner to move the container at least along one plane (recorded (x,y) in FIG. 2*a*) such that the opening for receiving the container can be moved vertically and laterally with respect to the splitting device 18.

In an advantageous manner, the device 36 is also suitable to move the container orthogonally to said plane, notably such that the opening of the container can be released from the splitting device 18 so that segments 12T that it receives can be removed.

Furthermore, in an advantageous manner, the spacing between the outlet of the splitting device 18 and the receiving opening of the container is chosen such that the end of segments 12T arranged in the container is at a chosen distance from the receiving opening of the container. For example, said spacing is chosen as approximately a few centimetres.

It is noted that, in an advantageous manner, the container 32 is fixed to the device 36.

In an advantageous configuration, the device 36 is arranged such that the container 32 is at an angle with respect to the horizontal. For example, its opening is situated at a point that is higher than its bottom.

The device 36 is arranged in an alternative or parallel manner so that the container is pivoted with respect to its longitudinal axis. For example, the container 32 is therefore arranged such that one of its edges is oriented towards the bottom.

In either of said configurations, the container can only be movable along the x axis.

Figure 3A:
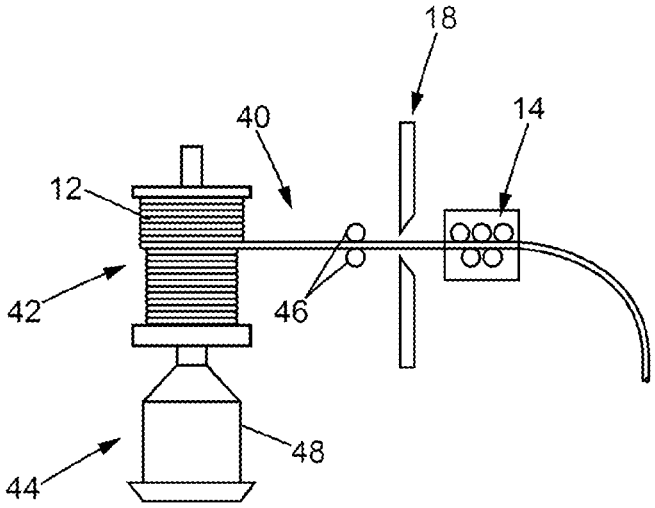
FIGS. 3*a* to 3*c* illustrate an assembly according to a second variant of the disclosure.
Figure 3B:
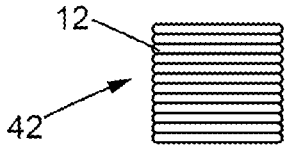
Figure 3C:
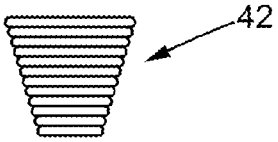

In a third embodiment illustrated in FIGS. 3*a*, 3*b* and 3*c*, the device comprises, along with the elements described above, a winding device 40 which is suitable for forming at least one reel 42 from portions 12P of cable 12 which have been brought to the high point H.

The winding device 40 is, for example, placed at the high point H, downstream of the splitting device 18.

The winding device 40 comprises a winding machine 44 and guide rollers 46.

The winding machine 44 is suitable to wind the cable portions 12 so as to form a reel 42. To this end, the winding machine is configured to pivot on itself along an axis, for example by means of the action of a driving device 48 of the winding machine 44.

In an advantageous manner, the winding device is also movable in a translatory manner along its axis of rotation.

The guide rollers 46 are provided to be coupled with the cable 12 and are suitable to guide the portions 12P which pass them towards the winding machine 44. Furthermore, in an advantageous manner, they are configured to control the tension in the cable 12 when the cable is wound on the winding machine, in particular when the winding machine is moved along its axis of rotation.

As illustrated in FIGS. 3*b* and 3*c*, the formed reel or reels 42 can have various forms. In particular, the reels can have a straight cylindrical form, or even a frustoconical or conical form.

Figure 4:
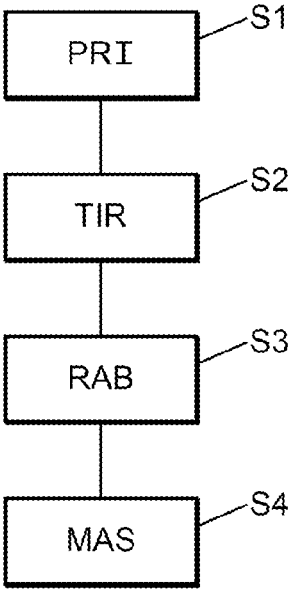
FIG. 4 is a block diagram illustrating a method according to the disclosure.

The method according to the disclosure for producing a ballast weight is now going to be described with reference to the Figures, notably to FIG. 4.

In a general manner, the method according to the disclosure comprises:

connecting the cable 12 to the conveying device 14, inducing movement of the cable via the conveying device 14 for conveying successive portions 12P of the cable 12 to the high point, forming the ballast weight from all or part of the portions 12P conveyed in this manner to the high point H.

As described in more detail below, forming the ballast weight from portions 12P comprises forming the ballast weight from all or part of the segments 12T formed from the portions 12P.

Here, the phrase "form from" is to be understood as the ballast weight comprising at least the elements in question, and being able to comprise other objects.

Said forming can comprise arranging the segments in a housing 50 from which the ballast weight is formed. Said housing 50 corresponds, for example, to the housing suspended from the frame of the damping device in FIG. 1. Said housing is in any form whatsoever. It is, for example, parallelepipedic in certain realizations.

Within the framework of the method, initially, the cable 12 is situated in total or in part at the low point. It is, for example, arranged in a dispenser conveyed to point B. The dispenser is, for example, arranged aligned with the ascent route.

It is noted that initially, only the first part $\mathbf{12}_1$ of the cable can be situated at the low point B.

During a stage S1, the cable is connected to the conveying device 14.

In an advantageous manner, to do this, an end of the cable 12 is engaged in the pulling apparatus 20.

For example, to this end, the end of the cable 12 is fixed to a traction means in the vicinity of the low point B, such as a winch cable. The winch is, for example, arranged at the high point H.

By means of the traction means, the end of the cable is pulled up to the high point to be engaged in the pulling apparatus 20.

Furthermore, in the assembly configurations having the relay stations 14R, the cable is engaged in the relay stations 14R. Said engaging is realized, for example, when the end of the cable arrives at the relevant relay station, and is then guided, for example, via a window which is provided in the pipe at the relay station 14R. As an alternative to this, said engaging is realized once the end of the cable is conveyed to the pulling apparatus 20.

During a subsequent stage S2, the conveying device 14 is actuated for moving portions 12P in the direction of the high point H.

The cable is thus hauled in the direction of the high point, the effect of which is to move the successive portions 12P of the cable in the direction of the high point until they arrive at the high point H. As indicated previously, the pulling device 20 and the relay stations 14R (if there are any) are therefore synchronized.

The details of the processing of the portions 12P once they have been conveyed to the high point H vary in terms of the embodiment considered.

Within the framework of the embodiment in FIG. 1, the portions 12P, conveyed to the high point H, pass into the splitting device 18 one after another after leaving the pulling apparatus 20.

The splitting device 18 therefore splits the cable at the portions conveyed so as to form segments 12T of a chosen length.

In an advantageous manner, said length is chosen so as to be in excess of the diameter of the cable. In an advantageous manner again, it is chosen so as to be in excess of or equal to twice the diameter of the cable.

For example, it is taken to be equal to substantially twice the diameter of the cable.

The segments are discharged into the container 32 when leaving the splitting device 18, as an option via the dispenser 30.

Once the container 32 comprises a desired quantity of segments 12T, and provided that the ballast requirements are not met at the high point H, the container 32 is discharged, for example into the housing 50 from which the ballast weight is, as a result, formed. As an option, said operation causes the pulling device 14 to be interrupted.

Within the framework of the embodiment in FIGS. 2*a* and 2*b*, the container 32 is initially arranged on the movement-inducing device 40. As an option, at least one strapping 38 is pre-positioned in a window of the container 32.

The portions 12P conveyed to the high point H pass one after another into the straightening device 34 when leaving the pulling apparatus 20. They then pass into the splitting device 18 and are engaged in the container 32, which is arranged on the movement-inducing device, through the receiving opening. Once the portion 12P, engaged in the container, presents a predetermined length, the splitting device 18 is actuated so as to split the cable 12 and form a segment 12T of a corresponding length which is then arranged in the container 32.

The container 32 is then moved, as an option, via the movement-inducing device for receiving, in the desired position within the container, the following portion 12P which will form a segment once the spitting apparatus 18 has been actuated. In particular, in an advantageous manner, it is moved such that the segments contained in the container are parallel to one another.

It is noted that the movement of the container can be implemented in response to the forming of a predetermined number, which is strictly in excess of 1, of segments 12T within the container. However, in an advantageous manner, said movement takes place for each new segment.

Once the container comprises a predetermined number of segments 12T, the strapping or strappings 38 are placed in position and tightened for forming a bundle of segments 12T within the container 32. The bundle formed is then removed from the container 32.

It is noted that for said operation, the container is advantageously distanced from the device 18. Furthermore, as an option, the conveying device is made inactive intermittently for the corresponding time period. Once the bundle has been removed, the container is replaced in position for receiving new portions 12P therein and for forming a new bundle.

Within the framework of the embodiment in FIG. 3, the portions 12P, conveyed to the high point H, pass one after another into the splitting device 18 then into the winding device 40. In particular, they pass into the guide rollers 46 and are wound on the winding machine 44. This latter is moved along its axis for winding the cable 12 onto the winding machine so as to form a reel in a chosen form and comprise an uninterrupted cable length.

Once the reel has been formed, the splitting device 18 is actuated so as to separate the cable length, spooled by the winding machine, from the rest of the cable, and thus to form a segment 12T within the meaning of the disclosure, which corresponds to the length of cable forming the reel.

The end of the cable 12 newly formed by the splitting device (and which corresponds to the free end of the cable 12, the portions 12P of which are situated on the ascent route 16) is, for example, connected to the winding machine and the guide rollers for forming a new reel.

During a stage S3, the cable part $\mathbf{12}_1$, which is in the process of ascending the ascent route under the effect of the conveying device, is spliced to a second cable part $\mathbf{12}_2$.

Said cable part is, for example, arranged in a dispenser which is supplied at the low point B. Said supplying takes place, for example, after the first cable part $\mathbf{12}_1$ has started to be pulled, or as an alternative to this parallel to the supplying of the part $\mathbf{12}_1$ to the low point B.

Regarding the splicing, the end of the part $\mathbf{12}_1$ of the cable situated at the low point is connected to an end of the second cable part $\mathbf{12}_2$. Said connection is realized, for example, by means of a weld, such as, for example, a capacitor discharge weld.

In an advantageous manner, said splicing is implemented when the dispenser, on which the first part $\mathbf{12}_1$ is initially situated, is substantially or completely emptied of cable 12.

For example, to this end, the assembly comprises a sensor (not shown) which is suitable to be in contact with the cable and is situated in the vicinity of the low point. The sensor is configured to trigger the stopping of the conveying device in response to the absence of contact with the cable. In practice, the sensor makes it possible to determine that the dispenser is empty, which triggers the stopping of the movement of the cable 12 so it can be spliced to the second part $\mathbf{12}_2$.

It is noted that said stage is not necessarily situated subsequent to the stage S2. Furthermore, it can be repeated in time so as to lengthen the cable 12 with new cable parts, so as to authorize the conveying of a desired quantity of ballast components without having to renew the initial stage of connecting a new cable to the pulling apparatus.

During a stage S4, the ballast weight 8 is formed from portions 12P conveyed to the high point. More specifically, it is formed from segments 12T.

As indicated previously, the ballast weight is, for example, in the form of a housing, within which the segments 12T are arranged.

During said stage, the housing is closed and is arranged within the damper where it forms the ballast weight 8. As an option, it is also hermetically sealed prior to its arrangement within the damper.

It is noted that parallel to the presence of segments, the ballast weight, as an option, comprises a ballast material (forming a ballast component other than the segments 12T) for filling at least part of the empty volume within the housing, that is to say not occupied by the segments 12T. Said ballast material is, for example, in contact with the segments 12T.

Said ballast material is advantageously fluid, at least initially. For example, said material comprises cement slurry.

The ballast material, as an option, comprises a high-density powder, such as a barite powder.

The ballast material, for example, is arranged, for example by injection, in the housing once the segments have been installed there.

In practice, the precise progression of said stage for forming the ballast weight depends on the conceived embodiment.

Within the framework of the first embodiment, the formed segments 12T are discharged into the housing 50 of the ballast weight from the container 32 once said container has been filled.

Once the housing comprises a desired quantity of segments, said latter is advantageously completed:

by sealing;

by filling voids with ballast material; and by closing the housing.

Moreover, said completion, as an option, includes re-arranging segments 12T in the housing so as to minimize the volume that they occupy there and increase the volume available for the ballast material.

Said arranging comprises, for example, placing segments in parallel with one another and in contact with one another within the housing.

Within the framework of the second embodiment, the ballast weight is formed from bundles of segments 12T. Once removed from the container 32, they are arranged in the housing and are intended to form the ballast weight. The housing comprises one or several bundles of segments 12T which are encircled and arranged in a chosen manner. For example, the bundles are juxtaposed and/or superposed there.

The housing is then completed, which includes its closure and, as an option, its sealing.

As previously, said completion includes, as an option, the addition of ballast material.

Within the framework of the embodiment in FIG. 3, once formed, the or several reels are arranged within the housing which is intended to form the ballast weight within the damper.

The relative arrangement of the reels can be chosen. Said choice is made, for example, so as to maximize the number of reels comprised in the volume of the container. For example, for conical reels, a given reel is advantageously arranged in the reverse position, that is to say upside down, with respect to at least one adjacent reel.

As an alternative to this or parallel to it, said choice is made so as to impart a chosen form on the arrangement of the reels, for example a pyramid form or other.

Once it contains a chosen number of reels, the housing is completed as previously.

It is noted that the embodiments of the different Figures can be combined together. For example, in a given configuration, the assembly 4 comprises the devices specific to each embodiment, the portions conveyed upward being selectively split so as to be discharged into a container, arranged in a container according to the principle in FIGS. 2*a* and 2*b*, or rather arranged on a reel according to the principle in FIGS. 3*a* to 3*c*.

In particular, the corresponding operating modes can be implemented one after another.

In practice, the shunting of the cable at the high point H towards the corresponding devices is realized, for example, by hand.

Moreover, the ballast weight can be formed from segments obtained via at least two embodiments amongst the one in FIG. 1, the one in FIG. 2*a* and the one in FIG. 3*c*.

In certain configurations, the choice can be made to install the containers 32 used, notably within the framework of the embodiment in FIG. 1, directly into the housing forming the ballast weight.

Thus, for example, the container 32 in FIG. 1 is therefore installed in the housing once it is filled, a new container 32 being placed in position for receiving newly formed segments.

The disclosure has numerous advantages. In effect, it enables ballast weights to be realized at height according to a method which does not mobilize any cranes or other apparatuses required for other tasks in a prolonged manner.

Furthermore, the associated assembly 4 is simple and relatively non-expensive.

In the same way, the method does not have a limit in terms of weight which can be conveyed or in terms of a maximum height.

Finally, it enables the conveying of a large ballast weight in a limited time and/or in a concealed time, that is to say outside of the "critical path" of the construction planning of the structure.

The invention claimed is:

1. A method of producing a ballast weight for damping vibrations of a structure, the structure having a low point and a high point, the ballast weight comprised of ballast components including at least part of a ballast cable, the ballast cable having successive portions, the method comprising:

connecting the ballast cable to a conveying device, by means of the conveying device, moving successive portions of the ballast cable from the low point to the high point, and forming the ballast weight from at least part of the successive portions of the ballast cable which have been conveyed to the high point.

2. The method according to claim 1, in which the ballast cable comprises initially a first cable part situated in a vicinity of the low point, the method furthermore comprising:

obtaining a second cable part in the vicinity of the low point, and splicing an end of the first cable part to an end of the second cable part.

3. The method according to claim 1, in which the cable is moved by the conveying device in a duct which extends over at least part of a path between the low point and the high point.

4. The method according to claim 1, in which forming the ballast weight comprises filling at least part of a volume within the ballast weight, and within which the successive portions are arranged, with a ballast material.

5. The method according to claim 1, in which, for at least part of the successive portions:

an initial portion of said successive portions is connected to a winding device once conveyed to the high point, the winding device is actuated while new portions reach the high point so as to form, via the winding device, at least one reel from the successive portions conveyed to the high point.

6. The method according to claim 5, in which the winding device comprises guide rollers, which are configured in order to guide the successive portions of the ballast cable and to control the tension of the ballast cable, and a winding machine on which the successive portions of ballast cable are wound.

7. The method according to claim 1, further comprising:

splitting the ballast cable at least at one portion which has been conveyed to the high point so as to form, from the ballast cable, ballast segments which are separate from one another.

8. The method according to claim 7, in which the ballast weight is formed from the ballast segments obtained from portions of the ballast cable.

9. The method according to claim 7, further comprising:

a housing from which the ballast weight is formed, in which the ballast segments are arranged in the housing.

10. The method according to claim 7, in which, for at least part of the successive portions, each ballast segment newly formed from said successive portions is arranged in a container.

11. The method according to claim 10, in which the container is movable along at least one axis and inside delimits a receiving cavity which has a receiving opening and in which, for at least part of the successive portions:

each portion conveyed to the high point is engaged through the receiving opening by means of the conveying device before being split from rest of the cable in order to form a respective said ballast segment which is arranged in the container, and the container is regularly moved until a predetermined number of ballast segments are received in the container.

12. The method according to claim 11, in which the container has a window, the method further comprising:

tightening the ballast segments received in the container together by means of a strapping which is engaged through said window for forming a bundle of said ballast segments.

* * * * *